US010422256B2

(12) United States Patent
Lee

(10) Patent No.: US 10,422,256 B2
(45) Date of Patent: Sep. 24, 2019

(54) ENGINE BRAKE DEVICE

(71) Applicants: Hyundai Motor Company, Seoul (KR); Kia Motors Corporation, Seoul (KR)

(72) Inventor: Won Seok Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/830,855

(22) Filed: Dec. 4, 2017

(65) Prior Publication Data

US 2019/0078474 A1 Mar. 14, 2019

(30) Foreign Application Priority Data

Sep. 12, 2017 (KR) ..... 10-2017-0116438

(51) Int. Cl.

| | |
|---|---|
| ***F01L 13/06*** | (2006.01) |
| ***F01L 1/18*** | (2006.01) |
| ***F01L 1/24*** | (2006.01) |
| *F01L 13/00* | (2006.01) |
| *F01L 1/04* | (2006.01) |

(52) U.S. Cl.

CPC ..... *F01L 13/06* (2013.01); *F01L 1/18* (2013.01); *F01L 1/2416* (2013.01); *F01L 1/04* (2013.01); *F01L 2013/105* (2013.01)

(58) Field of Classification Search

CPC . F01L 13/06; F01L 1/2416; F01L 1/18; F01L 1/04; F01L 2013/105

See application file for complete search history.

(56) References Cited

U.S. PATENT DOCUMENTS

2012/0298057 A1* 11/2012 Janak ..... F01L 1/08 123/90.12

* cited by examiner

*Primary Examiner* — Xiao En Mo

(74) *Attorney, Agent, or Firm* — Mintz Levin Cohn Ferris Glovsky and Popeo, P.C.; Peter F. Corless

(57) ABSTRACT

An engine brake device is provided for attenuating compression. The device is able to brake engine by attenuating a pressure increase in a cylinder by temporarily opening an exhaust valve at the end of a compression stroke of the engine, using an eccentric assembly eccentrically coupled to a pivot center of an exhaust rocker arm and an actuator for pushing up the eccentric assembly.

14 Claims, 13 Drawing Sheets

Cross-section A-A'

Cross-section B-B'

Cross-section C-C'

VIEW "X"

Cross-section A-A'

Cross-section B-B'

Cross-section C-C'

VIEW "X"

Cross-section A-A'

Cross-section B-B'

Cross-section C-C'

ENGINE BRAKE DEVICE

CROSS REFERENCE TO RELATED APPLICATION

The present application claims priority to Korean Patent Application No. 10-2017-0116438, filed Sep. 12, 2017, the entire contents of which is incorporated herein for all purposes by this reference.

BACKGROUND

Field of the Invention

The present invention relates to an engine brake device and, more particularly, to an engine brake device for attenuating compression that is capable of attenuating a pressure increase in a cylinder by opening an exhaust valve at the end of a compression stroke of an engine.

Description of the Related Art

A hydraulic brake is generally used for the brake system of internal combustion engine vehicles, but an engine brake is used to prevent brake pads from being quickly worn or deteriorated due to downhill-driving or frequent sudden stopping. A common engine brake is known to decelerate a vehicle by reducing a gear ratio, but this applies excessive load to the parts of an engine, thereby decreasing the lifespan of the engine. Accordingly, large vehicles, such as a truck or a bus, are equipped with a specific engine brake device that is not a gear ratio reducing type to decrease load caused by a hydraulic brake which are heavy and to improve stability in driving.

In other words, engine brake devices, capable of obtaining an engine brake effect through delay and attenuation of a compression stroke by discharging compressed air in a cylinder to the outside by temporarily opening an exhaust valve at the end of the compression stroke of the basic four strokes of the engine, that is, when a piston comes close to the top dead center in the compression stroke, have been used. However, existing engine brake devices have a disadvantage that the structure is complex and the manufacturing cost is high.

SUMMARY

The present invention provides an engine brake device for attenuating compression, the device being able to brake engine by attenuating a pressure increase in a cylinder by temporarily opening an exhaust valve at the end of a compression stroke of the engine, using an eccentric assembly eccentrically coupled to a pivot center of an exhaust rocker arm and an actuator for pushing up the eccentric assembly.

In order to achieve the objects of the present invention, an engine brake device for attenuating compression may include: an exhaust rocker arm configured to open or close an exhaust valve of an engine; an eccentric assembly having a rotational center point at a different position from a rotational center point of the exhaust rocker arm, and coupled to a side of the exhaust rocker arm; an actuator connected to a front end of the eccentric assembly to pivot the eccentric assembly about the rotational center point at a different position of the rotational center point of the exhaust rocker arm; a roller mounted at a rear end of the exhaust rocker arm to come in contact with or separate from a cam of a camshaft; and a projection formed at a predetermined position of a perfect circle of the cam, in which when the eccentric assembly pivots, the rear end of the exhaust rocker arm is configured to move downward causing the roller to contact the cam, and when the cam is rotated, the projection pushes up the exhaust rocker arm and the exhaust valve is temporarily opened.

The eccentric assembly may include: a disc having an aperture in which a fixed shaft may be inserted; a lever that extends integrally from the disc and connected to a plunger of the actuator; and an eccentric projective ring integrally formed on an inner side of the disc eccentrically from the rotational center point of the eccentric assembly and circumferentially slidably inserted in one side of the exhaust rocker arm. A circular groove being slidably in contact with an outer side of the eccentric projective ring inserted therein may be formed on the first side of the exhaust rocker arm. A plate spring configured to provide an elastic return force that presses the front end of the exhaust rocker arm to a valve bridge may be connected between a spring stopping end formed at the rear end of the exhaust rocker arm and the fixed shaft.

A solenoid valve for allowing or blocking supply of high-pressure oil may be connected to the actuator. In particular, a first oil supply channel having a first spring and a piston therein, a second oil supply channel having a plunger being movable vertically therein, a first connection channel that connects the first oil supply channel and the second oil supply channel to each other, an oil discharge channel that communicates with the second oil supply channel and includes a second spring and a reset bar therein, and a second connection channel that connects the first oil supply channel and the oil discharge channel to each other may be formed in the actuator.

When the piston of the actuator is pushed up by an elastic return force of the first spring, the first oil connection channel may be blocked, and when the piston is pushed down by pressure of oil supplied to the first oil supply channel, the oil may be supplied to the second oil supply channel through the first connection channel and the plunger may be pushed up. A stopping step may be formed at a top on an inner side of the second oil supply channel, a stopper that is stopped by the stopping step (e.g., blocked from further movement) and a spring support end may be formed around a lower portion and a lower end of the plunger, respectively, and a third spring may be inserted between the stopping step and the spring support end.

When the reset bar of the actuator is pushed up by an elastic return force of the second spring, the oil discharge channel may be blocked by a valve body formed at a lower portion of the reset bar. When the reset bar is pressed down by the exhaust rocker arm, the valve body formed at the lower portion of the reset bar may be moved down and the oil discharge channel may be opened, and thus, oil in the first oil supply channel and the second oil supply channel may be discharged through the oil discharge channel. A pressing end configured to press down the reset bar may be integrally formed at the front end of the exhaust rocker arm, and when the roller of the exhaust rocker arm is pushed up by a start point of a nose of the cam, the pressing end may be configured to press the reset bar down.

The present invention provides the following effects through this configuration.

First, as a pressure increase in the cylinder is attenuated by temporarily opening an exhaust valve at the end of a compression stroke of an engine, an engine brake effect by delay and attenuation of a compression stroke may be more easily provided.

Second, according to existing engine brake devices, it is required to directly form an oil supply aperture in a fixed shaft (rocker shaft) on which an exhaust rocker arm is fitted and directly disposing an actuator in the exhaust rocker arm, and thus the structure is rather complex. Accordingly, assembly thereof is also complex thus increasing the manufacturing costs. However, the engine brake device of the present invention has a simplified structure assembled by combining an eccentric assembly eccentrically coupled to a pivot point of an exhaust rocker arm and an actuator configured to push up the eccentric assembly, and thus, the device may be assembled more easily and the manufacturing cost maybe reduced.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
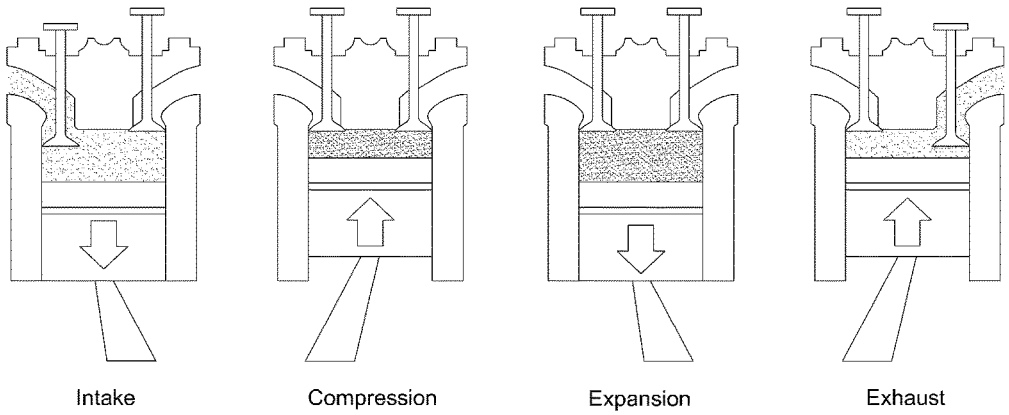
FIG. 1 is a schematic view showing a basic four-stroke cycle of an engine according to an exemplary embodiment of the present invention.

Hereinafter, exemplary embodiments of the present invention are described in detail with reference to the accompanying drawings. Referring to FIG. 1, in general, an engine fundamentally repeats a four-stroke cycle of intake, compression, expansion, and exhaust in operation.

Figure 2:
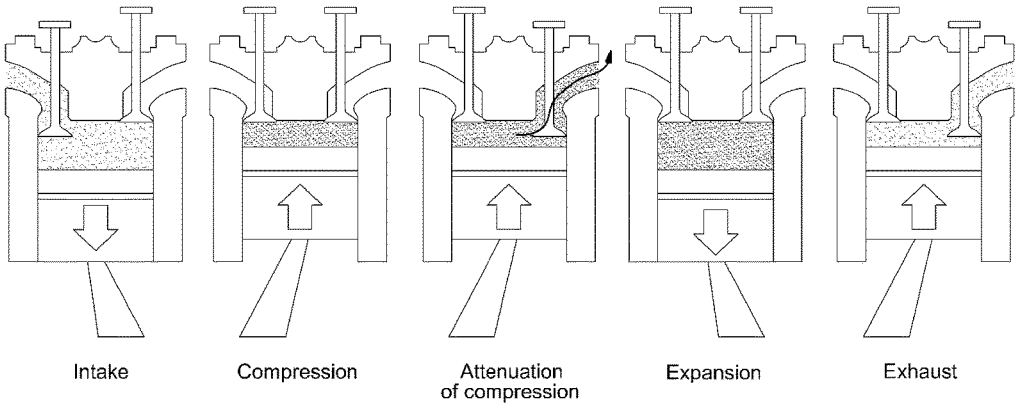
FIG. 2 is a schematic view showing compression attenuation at the end of a compression stroke for an engine brake in the basic four strokes of an engine according to an exemplary embodiment of the present invention.

An engine brake effect may be achieved through delay and attenuation of the compression by discharging the compressed air in a cylinder to the outside by temporarily opening an exhaust valve at the end of the compression stroke of the basic four strokes of the engine, as shown in FIG. 2, that is, when a piston comes close to the top dead center in the compression stroke. The present invention has been made to provide an engine brake device capable of providing an engine brake effect through delay and attenuation of a compression stroke by attenuating a pressure increase in a cylinder by temporarily opening an exhaust valve at the end of the compression stroke.

Figure 3:
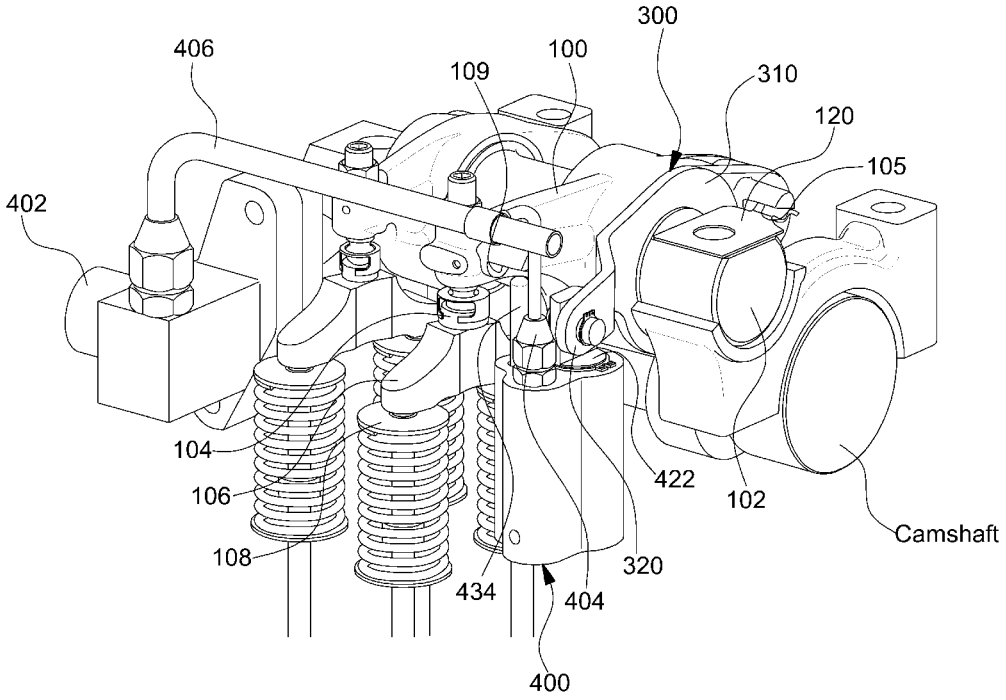
FIG. 3 is a view showing an engine brake device according to an exemplary embodiment of the present invention.

FIG. 3 shows an engine brake device according to the present invention, in which reference numeral '100' indicates an exhaust rocker arm configured to open or close an exhaust valve. An element foot 104 may be mounted at the front end of the exhaust rocker arm 100 and may be in contact with a valve bridge 106 connected to an exhaust valve 108. Further, a roller 110, which a cam 200 of a camshaft comes in contact with or separates from, may be mounted at the rear end of the exhaust rocker arm 100.

The cam 200 may be divided into a base circle 202 and a nose 204 in accordance of the profile and a projection 206 that comes in contact with and pushes up the roller 110 when the engine brake is operated may be formed at a predetermined position on the base circle 202. A plate spring 120 may be connected between a spring stopping end 105 formed at the rear end of the exhaust rocker arm 100 and a fixed shaft 102. The plate spring 120 may be configured to provide an elastic return force that lifts the rear end of the exhaust rocker arm 100 and move the front end of the rocker arm 100 in close contact with a valve bridge 106.

Figure 4:
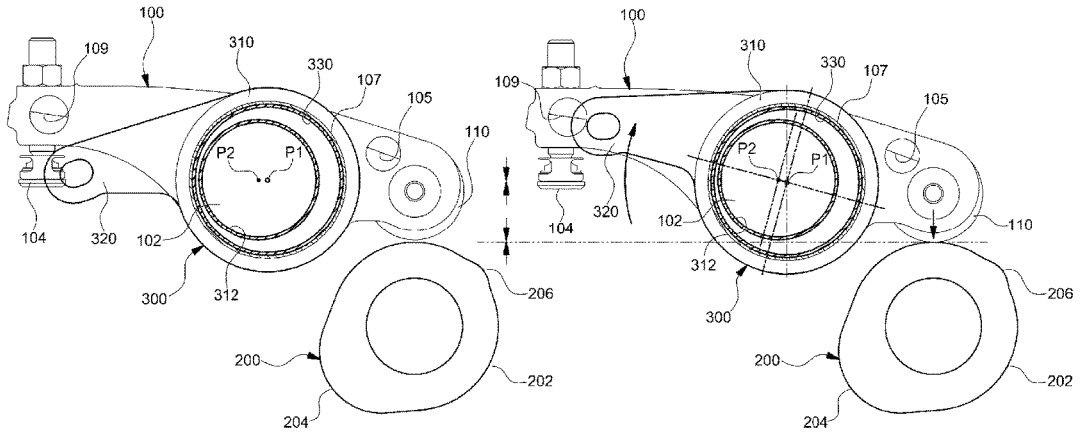
FIG. 4 is a view showing a coupling relationship between an exhaust rocker arm and an eccentric assembly in the engine brake device according to an exemplary embodiment of the present invention.
Figure 7:
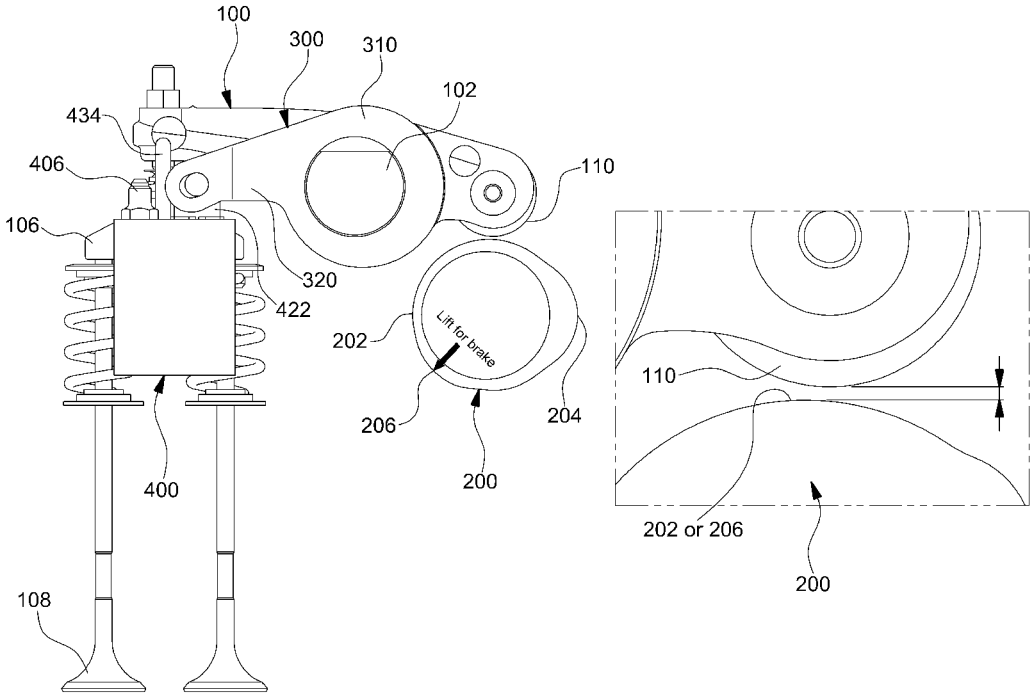
FIGS. 7 to 11 are views showing the state in which the engine brake device according to an exemplary embodiment of the present invention is not in operation.
Figure 8:
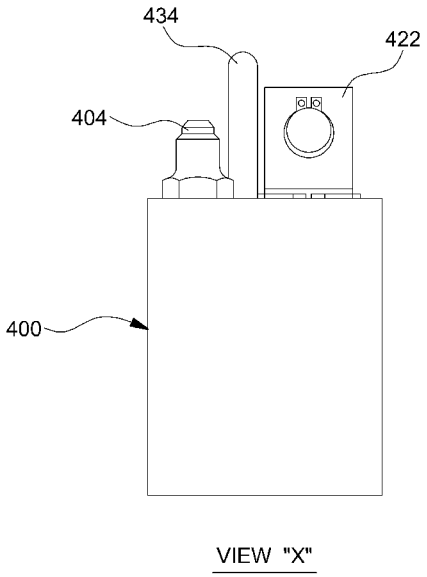

Referring to FIG. 7, the roller 110 at the rear end of the exhaust rocker arm 100 may remain spaced from the base circle 202 of the cam 200 by the elastic return force of the plate spring 120. However, the roller 110 may be pushed up by the nose 204 of the cam 200 in contact with the nose 204 in the exhaust stroke. As shown in FIG. 4, an eccentric assembly 300 may be mounted on a first side of the exhaust rocker arm 100.

The eccentric assembly 300 has a rotational center point P2 at a different position from the rotational center point P1 of the exhaust rocker arm 100, and may be mounted pivotably on the first side of the exhaust rocker arm 100. The eccentric assembly 300 may include an eccentric disc having a aperture 312 in which the fixed shaft 102 is inserted, a lever 320 that extends integrally from the disc 310 and may be hinged to a plunger 422 of an actuator 400 to be described below, and an eccentric projective ring 330 formed on the inner side of the disc 310. The fixed shaft 102 may be inserted in the aperture 312 of the disc 310 and functions as a support when the eccentric assembly 300 pivots, and may pass through the center of the exhaust rocker arm 100 without interfering with the exhaust rocker arm.

In particular, the eccentric projective ring 330 may protrude integrally from the inner side of the disc 310 eccentrically from the rotational center point P2 of the electric assembly 300 and may slide circumferentially into a circular groove 107 formed on the first side of the exhaust rocker arm 100, whereby the eccentric projective ring 330 and the circular groove 107 of the exhaust rocker arm 100 are coaxially arranged.

Further, the eccentric projective ring 330 may protrude integrally from the inner side of the disc 310 eccentrically from the rotational center point P2 of the eccentric assembly 300, and the outer side of the eccentric projective ring 330 may form a circle inserted into the circular groove 107. Accordingly, as shown in FIG. 4, the center points of the eccentric projective ring 330 and the circular groove 107, that is, the rotational center point P1 of the exhaust rocker arm 100 and the rotational center point p2 of the eccentric assembly 300 may be set at different positions on the same line.

Even though the eccentric projective ring 330 has been inserted in the circular groove 107 of the exhaust rocker arm 100, since the outer side of the eccentric projective ring 330 is a circle, the exhaust rocker arm 100 may be configured to pivot freely about the rotational center point P1. Further, when the exhaust rocker arm 100 pivots, the inner side of the circular groove 107 and the outer side of the eccentric projective ring 330 may slide in contact with each other. A solenoid valve 402 may be connected to the actuator 400. The solenoid valve 400 may allow high-pressure oil from an oil supply to be supplied to the actuator 400 when it is turned on in response to an electrical signal, and may be configured to block oil from being supplied to the actuator when turned off.

Figure 5:
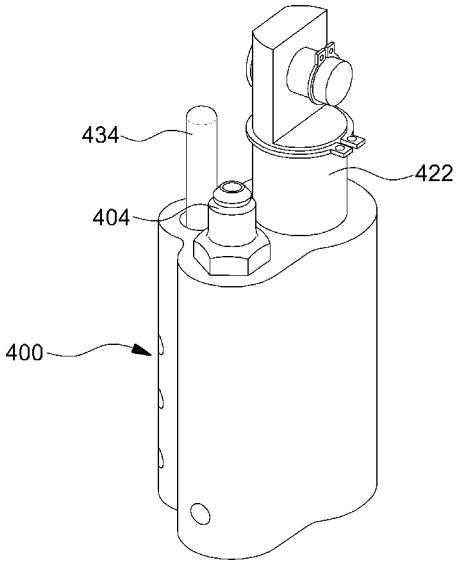
FIG. 5 is a perspective view of an actuator of the engine brake device according to an exemplary embodiment of the present invention.
Figure 6:
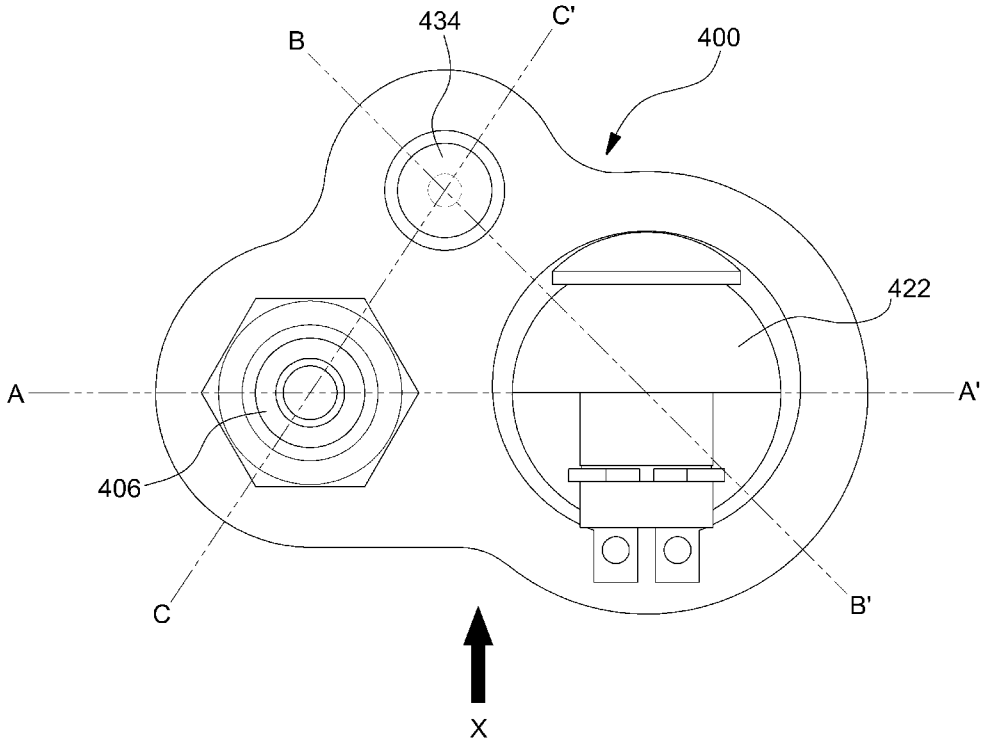
FIG. 6 is a plan view of the actuator of the engine brake device according to an exemplary embodiment of the present invention.
Figure 13:
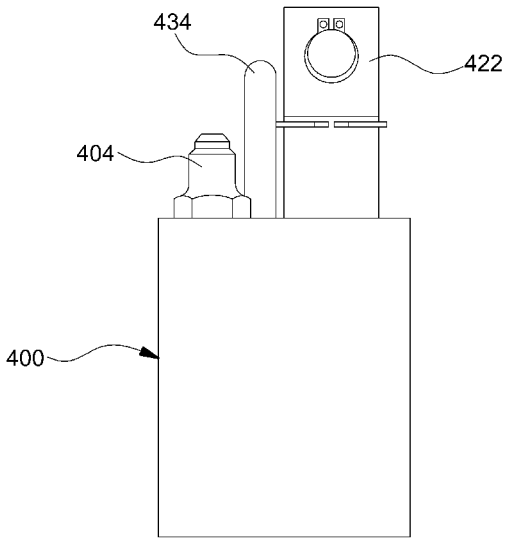
Figure 14:
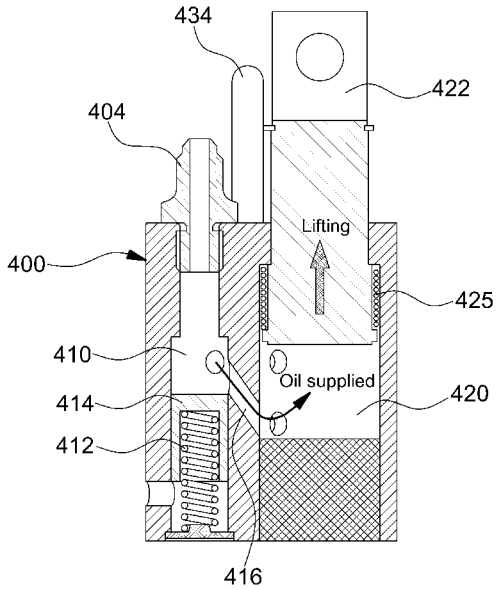
Figure 15:
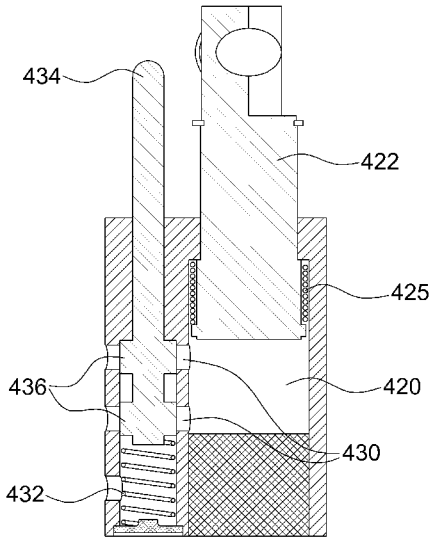
Figure 16:
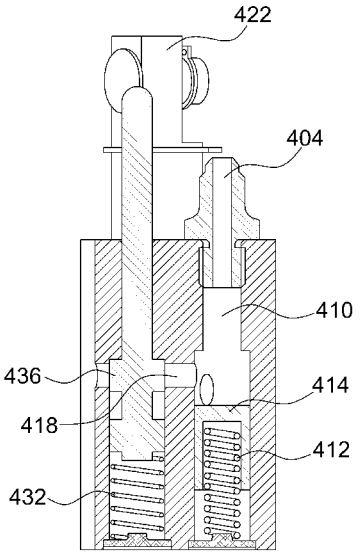

As shown well in FIGS. 13 to 15, a first oil supply channel 410 having a first spring 412 and a piston 414 therein, a second oil supply channel 420 having a plunger 422 being movable vertically therein, a first connection channel 416 that connects the first oil supply channel 410 and the second oil supply channel 420 to each other, an oil discharge channel 430 that communicates with the second oil supply channel 420 and having a second spring 432 and a reset bar 434 therein, and a second connection channel 418 connecting the first oil supply channel 410 and the oil discharge channel 430 to each other may be formed in the actuator 400. As shown in FIGS. 5 and 6, the plunger 422 and the reset bar 434 may be exposed through the top of the actuator 400 and a connector 406 to which an oil supply tube 404 extending from the solenoid valve 402 may be mounted on the inlet of the first oil supply channel 410.

The plunger 422 that protrudes through the top of the actuator 400 may be hinged by a hinge pin to the lever 320 of the eccentric assembly 300 and the reset bar 434 may be pressed down by a pressing end 109 integrally formed at the front end of the exhaust rocker arm 100. The operational flow of the actuator 400 having this configuration is described hereafter.

Figure 9:
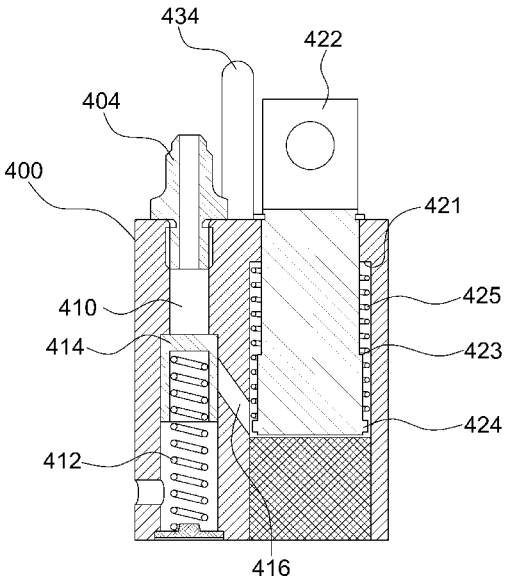
Figure 10:
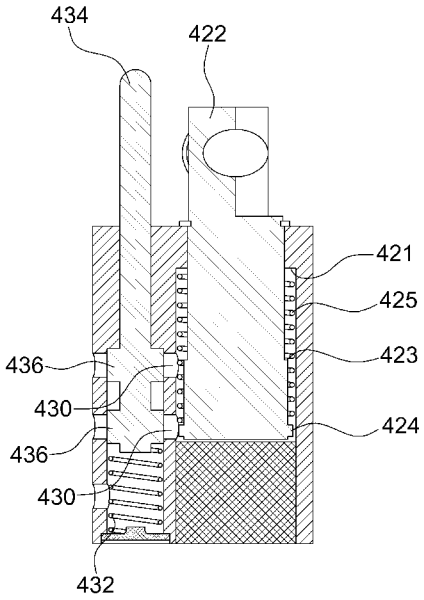
Figure 11:
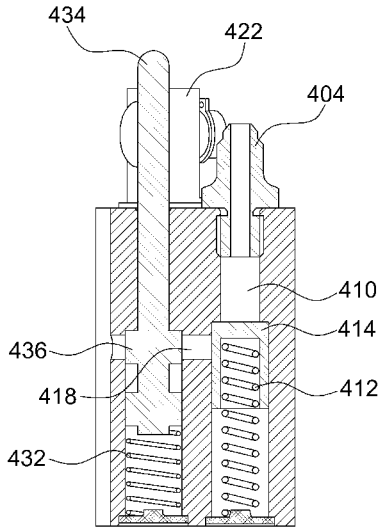

When the solenoid valve 402 is turned off (e.g., when the engine brake is not operated), as shown in FIG. 9, the piston 414 in the first oil supply channel 410 may be pushed up by the elastic return force of the first spring 412, and thus, the first connection channel 416 may be blocked. In this process, as shown in FIG. 10, the reset bar 434 may remain pushed up by the elastic return force of the second spring 432 until the reset bar 434 is pressed down by the pressing end 109 of the exhaust rocker arm 100, and the oil discharge channel 430 may be blocked by a valve body 436 formed at the lower portion of the reset bar 434.

When the solenoid valve 402 is turned on (e.g., when the engine brake is operated), as shown in FIG. 14, the piston 414 may be pushed down by the pressure of oil supplied to the first oil supply channel 410, and thus, oil may be supplied to the second oil supply channel 420 through the first connection channel 416 and the plunger 422 may be pushed upwards. A stopping step 421 may be formed at the top on the inner side of the second oil supply channel 420, a stopper 423 stopped by the stopping step 421 and a spring support end 424 may be formed around the lower portion and the lower end of the plunger 422, respectively, and a third spring 425 may be inserted between the stopping step 421 and the spring support end 424. The height of the plunger 422 when pushed upward may be limited to the height where the stopper 423 is stopped by the stopping step 421 and the plunger 422 may be returned down by the elastic return force of the third spring 425 when hydraulic pressure is removed.

Figure 20:
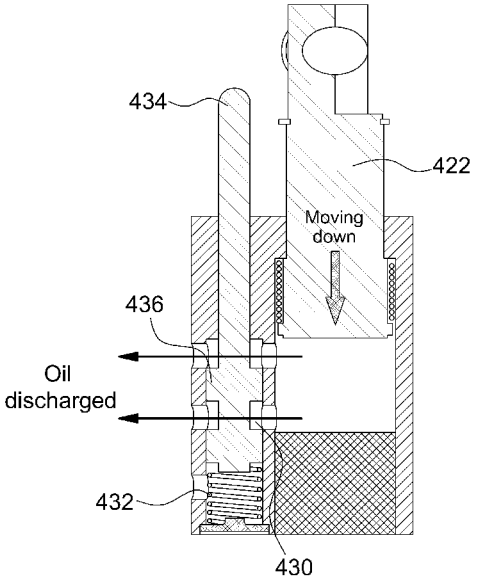
Figure 21:
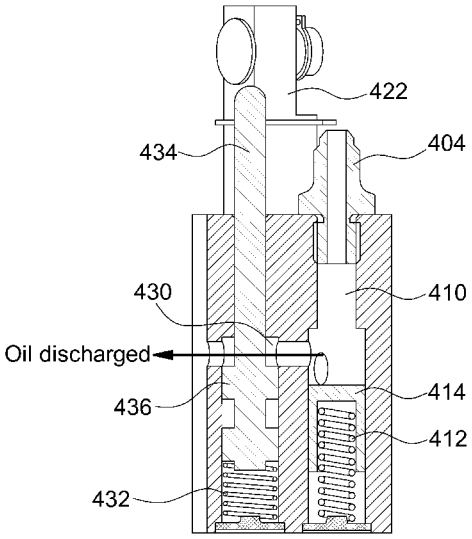

Further, when the solenoid valve 402 is turned on and the roller 110 of the exhaust rocker arm 100 is pushed up by being continuously brought in contact with the start point of the nose of the cam 200 and the top of the nose, the front end of the exhaust rocker arm 100 may be moved down and the pressing end 109 may be configured to press the reset bar 434 down. Accordingly, as the reset bar 434 is pressed down by the pressing end 109 of the exhaust rocker arm 100, as shown in FIGS. 20 and 21, the oil discharge channel 430 may be open while the valve body 436 formed at the lower portion of the reset bar 434 is moved down, and thus, the oil in the first oil supply channel 410 and the second oil supply channel 420 may be discharged through the oil discharge channel 430.

The operational flow of the engine brake device having this configuration of the present invention is described hereafter.

In Basic Strokes of Engine (Engine Brake not in Operation)

FIGS. 7 to 11 are views showing the state in which the engine brake device according to the present invention is not operated. The engine fundamentally repeats a four-stroke cycle of intake, compression, expansion, and exhaust when the engine brake device is not in operation.

When an engine brake switch (not shown) is off, the solenoid valve 402 may also remain off, so as shown in FIG. 9, the piston 414 in the first oil supply channel 410 may be pushed upward by the elastic return force of the first spring 412, thereby the first connection channel 416 may be blocked. Further, as shown in FIGS. 9 and 10, since oil is not supplied to the first oil supply channel 410, the plunger 422 may be moved down by the elastic return force of the third spring 425.

Further, as shown in FIG. 7, the lever 330, connected to the plunger 422, of the eccentric assembly 300 may remain under the rotational center point P2 of the eccentric assembly 300. Further, the rear end of the exhaust rocker arm 100 may be pushed up above the rotational center point P1 of the exhaust rocker arm 100 by the elastic return force of the plate spring 120, and thus, the element foot 104 formed at the front end of the exhaust rocker arm 100 may come in close contact with (e.g., abut) the valve bridge 106 and the roller 110 mounted at the rear end of the exhaust rocker arm 100 may remain spaced from the perfect circle 202 of the cam 200.

Accordingly, when the engine performs the four-stroke cycle of intake, compression, expansion, and exhaust, the roller 110 of the exhaust rocker arm 100 remains spaced from the perfect circle 202 of the cam 200 and the projection 206 in the intake, compression, and expansion strokes, and in the exhaust stroke, the cam 200 may be rotated and thus, the nose 204 of the cam 200 may be configured to push the roller 110 upwards. Therefore, the front end of the exhaust rocker arm 100 may be configured to pivot down about the rotational center point P1 and the element foot 104 of the exhaust rocker arm 100 may be configured to press the valve bridge 106 to move the exhaust stroke in which the exhaust valve 108 connected to the valve bridge 106 down and thus the exhaust valve 108 may be opened.

Engine Brake in Operation

FIGS. 12 to 16 are views showing the state in which the engine brake device according to the present invention is operated. When the engine brake of the present invention is operated, an engine brake effect may be achieved through delay and attenuation of the compression by discharging the compressed air in a cylinder to the outside by temporarily opening an exhaust valve the end of the compression stroke, that is when a piston comes close to (e.g., approaches) the top dead center in the compression stroke.

When an engine brake switch (not shown) is turned on, the solenoid valve 402 may be turned on, and as shown in FIG. 14, the piston 414 may be pushed down by the pressure of oil supplied to the first oil supply channel 410, and thus, oil may be supplied to the second oil supply channel 420 through the first connection channel 418 and the plunger 422 may be pushed up while compressing the third spring 425. The height of the plunger 422 when pushed up may be limited to the height where the stopper 423 is stopped by the stopping step 421 and the plunger 422 may be returned down by the elastic return force of the third spring 425 when hydraulic pressure is removed later.

Figure 12:
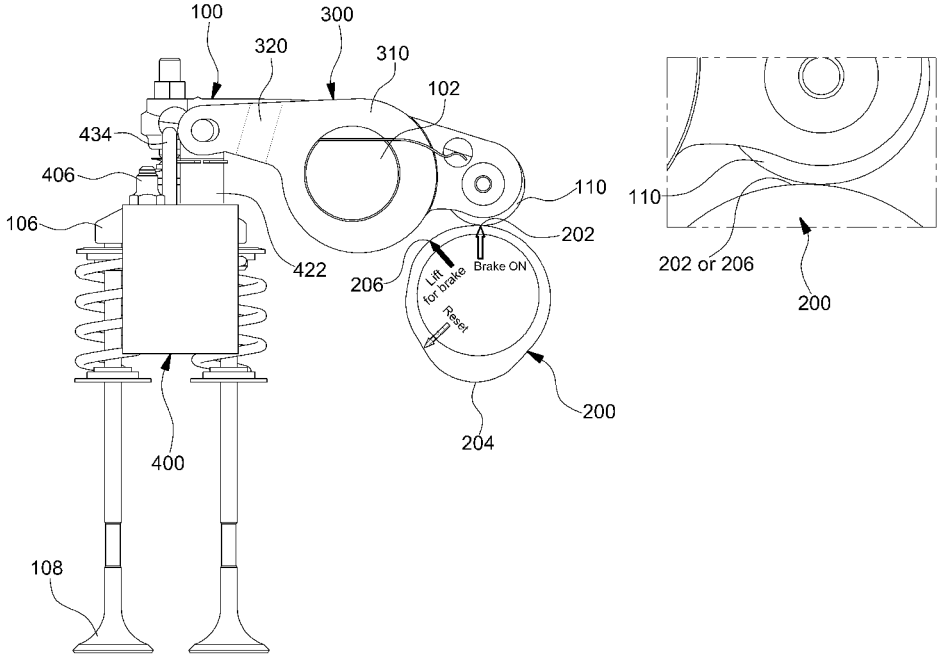
FIGS. 12 to 16 are views showing the state in which the engine brake device according to an exemplary embodiment of the present invention is in operation.

Further, the reset bar 434 may remain pushed up by the elastic return force of the second spring 432 until pressed down by the pressing end 109 of the exhaust rocker arm 100, and the oil discharge channel 430 may be blocked by a valve body 436 formed at the lower portion of the reset bar 434. Further, as shown in FIG. 12, as the plunger 422 is pushed upwards, the lever 320 may be configured to pivot clockwise (in the figure) about the rotational center point P2 of the eccentric assembly 300 and the disc 310 of the eccentric assembly 300 may also be configured to pivot in the same direction (clockwise) about the rotational center point P2.

In addition, the eccentric projective ring 330 on the inner side of the disc 310 of the eccentric assembly 300, that is, the eccentric projective ring 330 formed eccentrically from the rotational center point P2 may be configured to pivot in the same direction (clockwise). In this process, since the eccentric projective ring 330 is inserted to be circumferentially slidable in the circular groove 107 on the side of the exhaust rocker arm 100, the eccentric projective ring 330 may be configured to pivot clockwise about the rotational center point P2 of the eccentric assembly and the rear end of the exhaust rocker arm may also be configured to pivot in the same direction about the rotational center point P2 of the eccentric assembly 300.

Accordingly, before the eccentric assembly 300 pivots, the center point of the eccentric projective ring 330 and the circular groove 107, that is, the rotational center point P1 of the exhaust rocker arm 100 and the rotational center point P2 of the eccentric assembly 300 may be set at different positions on the same line, as shown at the left in FIG. 4, but after the eccentric assembly 300 pivots clockwise, the rotational center point P1 of the exhaust rocker arm 100 becomes lowers than the rotational center point P2 of the eccentric assembly 300, as shown at the right in FIG. 4. Further, as the rotational center point P2 of the exhaust rocker arm 100 lowers, the roller 110 at the rear end of the exhaust rocker arm 100 may come in close contact with the circle 202 of the cam 200.

Even though the eccentric projective ring 330 has been inserted in the circular groove 107 of the exhaust rocker arm 100, since the inner side of the circular groove 107 and the outer side of the eccentric projective ring 330 are circles, when the exhaust rocker arm 100 pivots, the inner side of the circular groove 107 and the outer side of the eccentric projective ring 330 may slide in contact with each other, and thus, the exhaust rocker arm 100 may pivot freely about the rotational center point P1. Accordingly, when the engine performs the four-stroke cycle of intake, compression, expansion, and exhaust, the roller 110 of the exhaust rocker arm 100 comes in contact with the projection 206 of the cam 200 at the end of the compression stroke, whereby the roller 110 may be pushed up by the projective height of the projection 206.

Further, the front end of the exhaust rocker arm 100 may be moved down about the rotational center point P1 in a same amount as the pushed-up amount of the roller 110 at the rear end of the exhaust rocker arm 100. The element foot 104 of the exhaust rocker arm 100 may be configured to press the valve bridge 106 and the exhaust valve 108 connected to the valve bridge 106 may be moved down and temporarily opened, whereby a pressure increase in the cylinder may be attenuated. Therefore, as a pressure increase in the cylinder is attenuated at the end of the compression stroke, an engine brake effect by delay and attenuation of a compression stroke may be provided.

Reset

FIGS. 17 to 21 are views showing the state in which the engine brake device according to the present invention is reset. The term 'reset' refers to a process of stopping the engine brake at each stroke of the engine. In particular, the 'reset' refers a process of returning the eccentric assembly 300 to the initial position by moving down the plunger 422 of the actuator 400 for the operation of the engine brake that temporarily opens again the exhaust valve 108 at the end of the next compression stroke.

Further, reset is required for each stroke of the engine, but when reset is not performed, a possibility of a collision between the exhaust valve and the engine piston may increase and thus, there is a need for a specific stopping mechanism for stopping the engine brake. In addition, there is a possibility of delay of lifting of the piston and reduction of the lifted amount due to a continuous decrease in oil pressure in the engine piston by continuous leakage of oil during operation of the engine brake.

Figure 17:
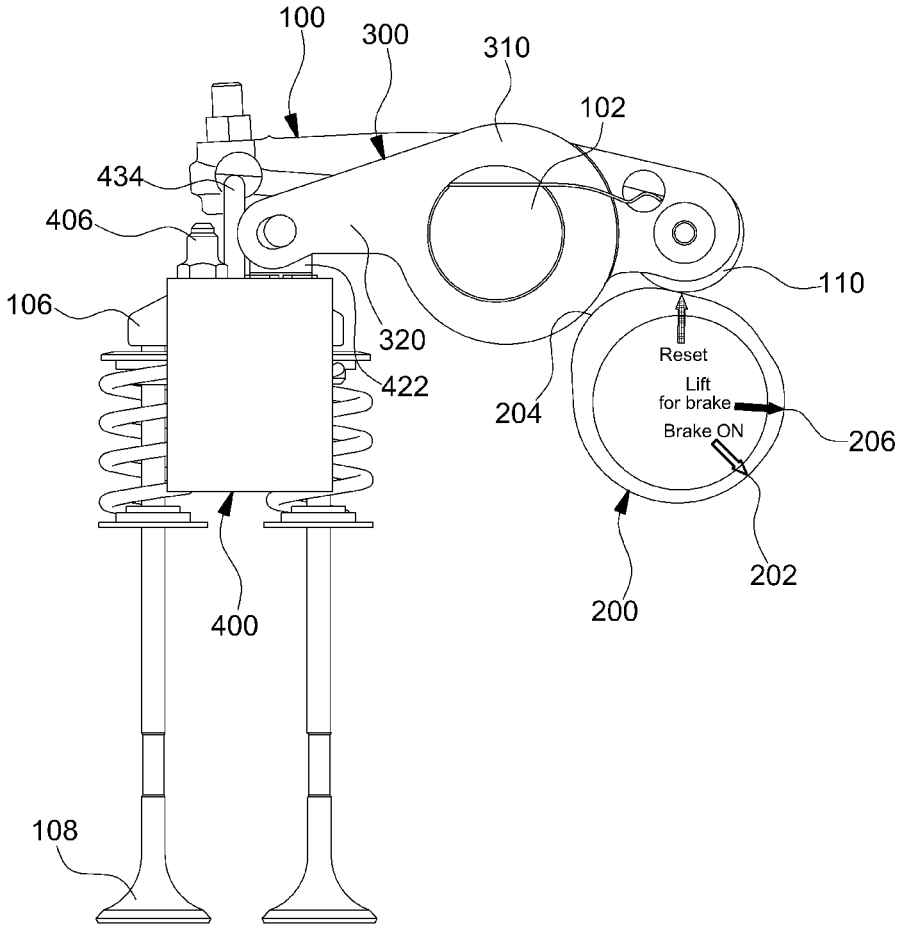
FIGS. 17 to 21 are views showing the state in which the engine brake device according to an exemplary embodiment of the present invention is reset.
Figure 18:
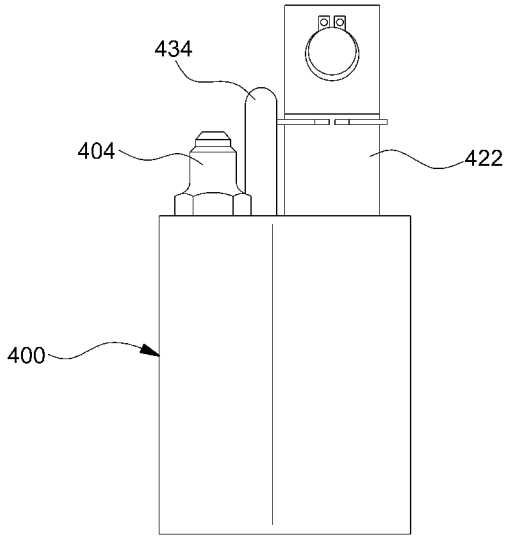
Figure 19:
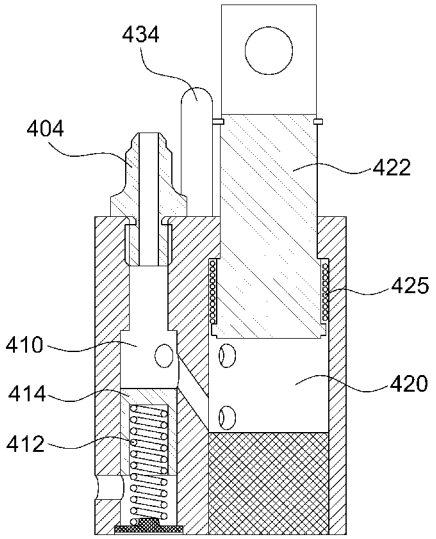

The reset may be performed at the point of further lifting of the roller 110 by the start point of the nose 204 of the cam 200 due to further rotation of the cam 200 after the roller 110 is brought in contact with the projection 206 of the cam 100 and then pushed up as much as the height of the projection 206. Accordingly, as shown in FIG. 17, the roller 110 of the rocker arm 110 may be pushed up higher when brought in contact with the start point of the nose 204 of the cam 200, that is, a portion that protrudes farther than the height of the projection 206, than when it is brought in contact with the projection 206.

Since the inner side of the circular groove 107 of the exhaust rocker arm 100 and the outer side of the eccentric projective ring 330 of the eccentric assembly 300 are capable of sliding in contact with each other, the exhaust rocker arm 100 may be configured to pivot freely about the rotational center point P1. As the roller 110 is pushed up higher, the front end of the exhaust rocker arm 100 may also be configured to further pivot counterclockwise about the rotational center point P1, and thus, the pressing end 109 at the front end of the exhaust rocker arm 100 may press down the reset bar 434 of the actuator 400.

In particular, when the solenoid valve 402 is turned on and the roller 110 of the exhaust rocker arm 100 is pushed up by being continuously brought in contact with the start point of the nose of the cam 200 and the top of the nose, the front end of the exhaust rocker arm 100 may be moved down and the pressing end 109 may be configured to press the reset bar 434 down. Accordingly, as the reset bar 434 is pressed down by the pressing end 109 of the exhaust rocker arm 100, as shown in FIGS. 20 and 21, the oil discharge channel 430 is open while the valve body 436 formed at the lower portion of the reset bar 434 is moved down, and thus, oil in the first oil supply channel 410 and the second oil supply channel 420 may be discharged through the oil discharge channel 430.

Further, as the oil in the first oil supply channel 410 is discharged, the plunger 422 may be returned down to the initial position by the elastic return force of the third spring 425. The lever 320 of the eccentric assembly 300 connected to the plunger 422 may also be pulled down, and thus, the eccentric assembly 300 may be returned to the position before the engine brake is operated.

Figure 22:
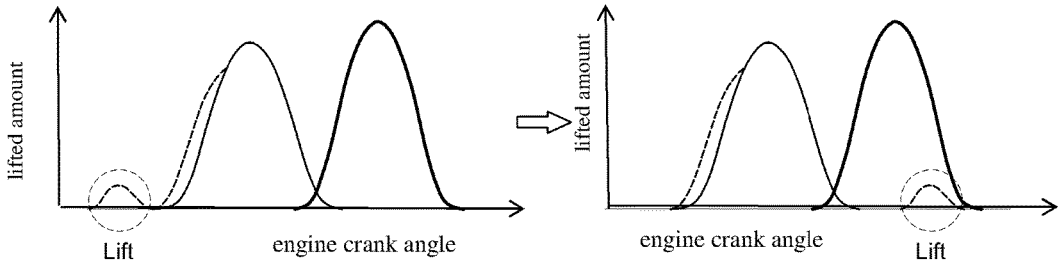
FIG. 22 is a graph showing that the engine brake device according to the present invention can be used a device for EGR by changing the lift profile of the engine brake device according to an exemplary embodiment of the present invention.

As described above, as the process of operating the engine brake and the process of resetting are repeated at each stroke of the engine, the engine brake effect according to attenuation of a compression stroke may be provided. Referring to FIG. 22, the engine brake device may be used as an internal exhaust gas recirculation (EGR) valve device by changing the lift profile of the engine brake device that is operated by the eccentric assembly 300 and the actuator 400 for operating the eccentric assembly 300, as described above.

What is claimed is:

1. An engine brake device for attenuating compression, comprising:

an exhaust rocker arm configured to open or close an exhaust valve of an engine;

an eccentric assembly having a rotational center point at a different position from a rotational center point of the exhaust rocker arm, and coupled to a first side of the exhaust rocker arm;

an actuator connected to a front end of the eccentric assembly to pivot the eccentric assembly about the rotational center point at a different position of the rotational center point of the exhaust rocker arm;

a roller mounted at a rear end of the exhaust rocker arm to come in contact with or separate from a cam of a camshaft; and a projection formed at a predetermined position of a circle of the cam, wherein when the eccentric assembly pivots, the rear end of the exhaust rocker arm moves down and the roller comes in close contact with the cam, and when the cam is rotated, the projection pushes the exhaust rocker arm up to temporarily open the exhaust valve.

2. The device of claim 1, wherein the eccentric assembly includes:

a disc having an aperture in which a fixed shaft is inserted;

a lever that extends integrally from the disc and connected to a plunger of the actuator; and an eccentric projective ring integrally formed on an inner side of the disc eccentrically from the rotational center point of the eccentric assembly and circumferentially slidably inserted in the first side of the exhaust rocker arm.

3. The device of claim 2, wherein a circular groove being slidably in contact with an outer side of the eccentric projective ring inserted therein is formed on the first side of the exhaust rocker arm.

4. The device of claim 1, wherein a plate spring configured to provide an elastic return force to press the front end of the exhaust rocker arm to a valve bridge is connected between a spring stopping end formed at the rear end of the exhaust rocker arm and the fixed shaft.

5. The device of claim 1, wherein a solenoid valve configured to permit or block supply of high-pressure oil is connected to the actuator.

6. The device of claim 1, wherein a first oil supply channel having a first spring and a piston therein, a second oil supply channel having a plunger being movable vertical therein, a first connection channel that connects the first oil supply channel and the second oil supply channel to each other, an oil discharge channel that communicates with the second oil supply channel and having a second spring and a reset bar therein, and a second connection channel that connects the first oil supply channel and the oil discharge channel to each other are formed in the actuator.

7. The device of claim 6, wherein when the piston is pushed up by an elastic return force of the first spring, the first oil connection channel is blocked.

8. The device of claim 6, wherein when the piston is pushed down by pressure of oil supplied to the first oil supply channel, the oil is supplied to the second oil supply channel through the first connection channel and the plunger is pushed up.

9. The device of claim 6, wherein a stopping step is formed at a top on an inner side of the second oil supply channel, a stopper that is blocked by the stopping step and a spring support end are formed around a lower portion and a lower end of the plunger, respectively, and a third spring is inserted between the stopping step and the spring support end.

10. The device of claim 6, wherein when the reset bar is pushed up by an elastic return force of the second spring, the oil discharge channel is blocked by a valve body formed at a lower portion of the reset bar.

11. The device of claim 6, wherein when the reset bar is pressed down by the exhaust rocker arm, a valve body formed at the lower portion of the reset bar is moved down and the oil discharge channel is opened, to discharge in the first oil supply channel and the second oil supply channel through the oil discharge channel.

12. The device of claim 11, wherein a pressing end configured to press down the reset bar is integrally formed at the front end of the exhaust rocker arm.

13. The device of claim 12, wherein when the roller of the exhaust rocker arm is pushed up by a start point of a nose of the cam, the pressing end is configured to press the reset bar down.

14. The device of claim 1, wherein the engine brake device implemented by the eccentric assembly and the actuator configured to push the actuator up is used as an internal exhaust gas recirculation valve device by changing a lift profile of the engine brake device.

* * * * *